US009314400B1

(12) United States Patent
Dudley

(10) Patent No.: US 9,314,400 B1
(45) Date of Patent: Apr. 19, 2016

(54) PERINEAL MASSAGE ASSEMBLY

(71) Applicant: Eric A. Dudley, Meriden, CT (US)

(72) Inventor: Eric A. Dudley, Meriden, CT (US)

( * ) Notice: Subject to any disclaimer, the term of this patent is extended or adjusted under 35 U.S.C. 154(b) by 685 days.

(21) Appl. No.: 13/682,066

(22) Filed: Nov. 20, 2012

(51) Int. Cl.
*A61H 23/00* (2006.01)
*A61H 99/00* (2006.01)

(52) U.S. Cl.
CPC ..... *A61H 99/00* (2013.01)

(58) Field of Classification Search
CPC ..... A61H 2201/0138; A61H 2201/0149; A61H 2201/0157; A61H 2201/0207; A61H 2201/0228; A61H 2201/1215; A61H 2201/1418; A61H 2201/1623; A61H 2201/1669; A61H 2201/1678; A61H 2201/5002; A61H 23/00; A61H 23/002
USPC ..... 601/15, 46, 49, 56, 57, 60, 64, 65, 67, 601/69, 70, 71, 78, 79, 84, 90, 134; 607/108, 112
See application file for complete search history.

(56) References Cited

U.S. PATENT DOCUMENTS

| | | | | |
|---|---|---|---|---|
| 3,710,784 | A * | 1/1973 | Taylor | 601/18 |
| 4,607,624 | A * | 8/1986 | Jefferson | 601/18 |
| 5,462,515 | A * | 10/1995 | Tseng | 601/57 |
| D423,188 | S | 4/2000 | Raffali | |
| 6,235,049 | B1 | 5/2001 | Nazerian | |
| 6,308,341 | B1 | 10/2001 | Shelton | |
| 6,436,029 | B1 | 8/2002 | Benderev | |
| 7,207,953 | B1 * | 4/2007 | Goicaj | 601/46 |
| 7,824,437 | B1 | 11/2010 | Saunders | |
| 2003/0028132 | A1 * | 2/2003 | Bastia et al. | 601/57 |
| 2006/0293719 | A1 * | 12/2006 | Naghavi | 607/41 |
| 2007/0255187 | A1 | 11/2007 | Branch | |
| 2008/0033326 | A1 * | 2/2008 | Evans | 601/15 |

* cited by examiner

*Primary Examiner* — Quang D Thanh

(57) ABSTRACT

A perineal massage assembly facilitates heating and stimulation of a perneal area to promote health and healing. The assembly includes an elongated pad having a top layer and a bottom layer. The pad is positioned adjacent to a perineum and anus of a person. The top layer of the pad is coupled to the bottom layer of the pad around a perimeter edge of the pad defining an interior space within the pad. A first vibratory motor is coupled to the pad and positioned in the interior space of the pad. A heating element is coupled to the pad and positioned in the interior space of the pad. A control unit is operationally coupled to the first vibratory motor and the heating element for selectively activating the first vibratory motor and the heating element.

9 Claims, 5 Drawing Sheets

PERINEAL MASSAGE ASSEMBLY

This application takes benefit of U.S. Provisional Patent Application 61/562,450 filed on Nov. 22, 2011, under 35 U.S.C. sec. 119.

BACKGROUND OF THE DISCLOSURE

Field of the Disclosure

The disclosure relates to perineal massage devices and more particularly pertains to a new perineal massage device for massaging and warming a user's perineal area.

SUMMARY OF THE DISCLOSURE

An embodiment of the disclosure meets the needs presented above by generally comprising an elongated pad having a top layer and a bottom layer. The pad is positioned adjacent to a perineum and anus of a person. The top layer of the pad is coupled to the bottom layer of the pad around a perimeter edge of the pad defining an interior space within the pad. A first vibratory motor is coupled to the pad and positioned in the interior space of the pad. A heating element is coupled to the pad and positioned in the interior space of the pad. A control unit is operationally coupled to the first vibratory motor and the heating element for selectively activating the first vibratory motor and the heating element.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
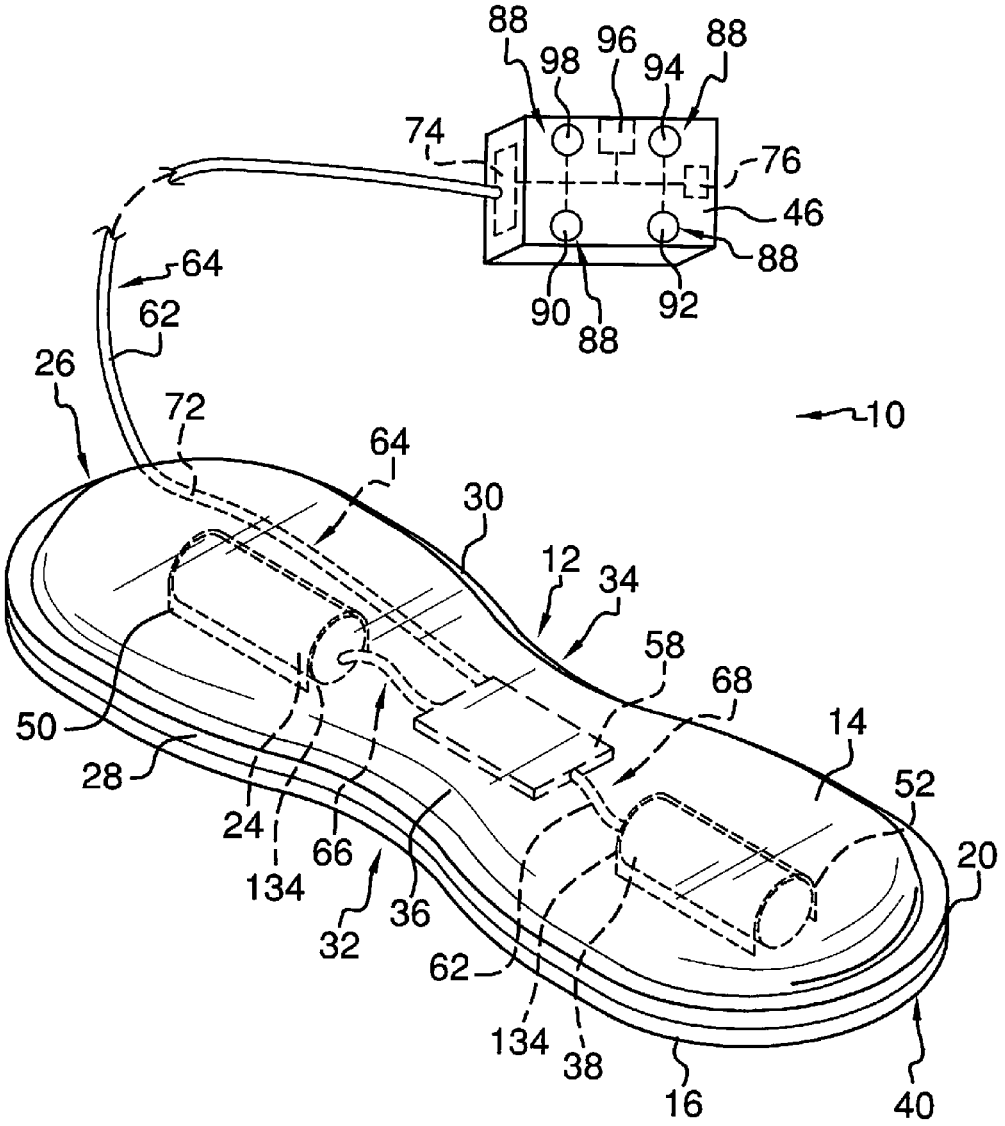
FIG. 1 is a perspective view of a perineal massage assembly according to an embodiment of the disclosure.
Figure 2:
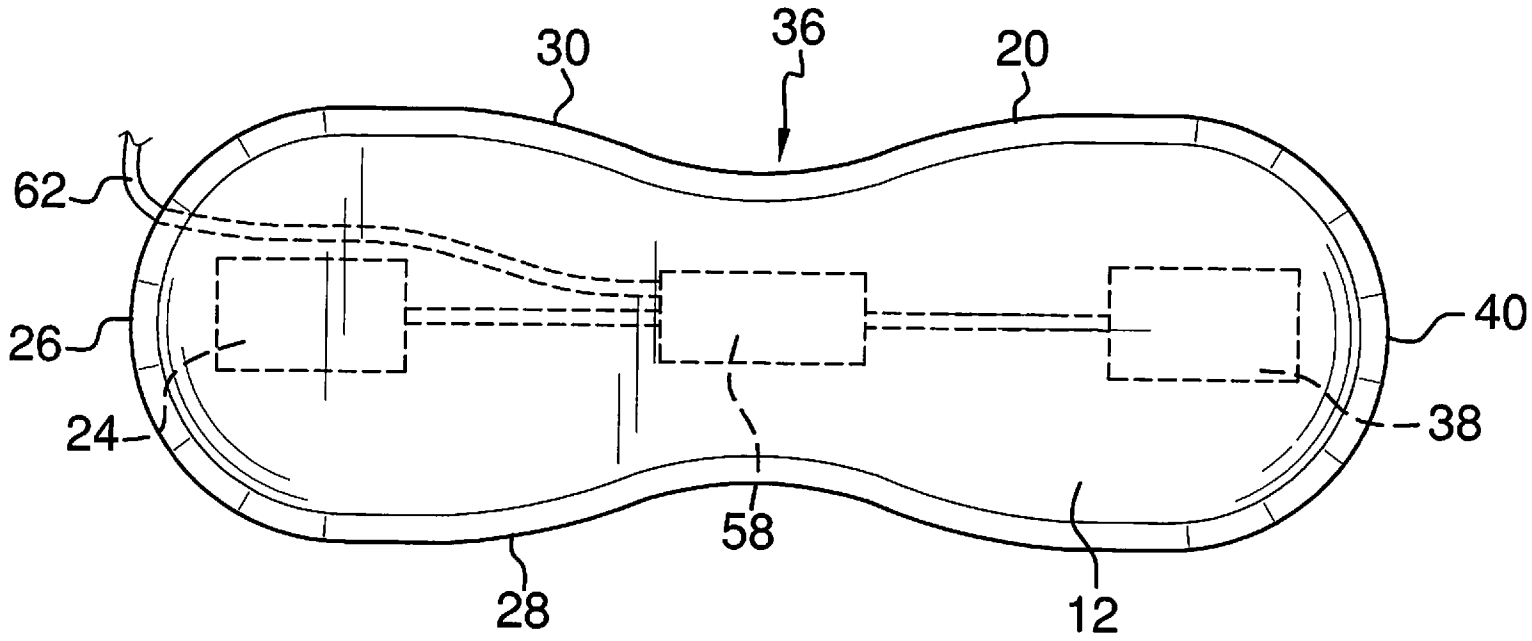
FIG. 2 is a bottom view of an embodiment of the disclosure.
Figure 3:
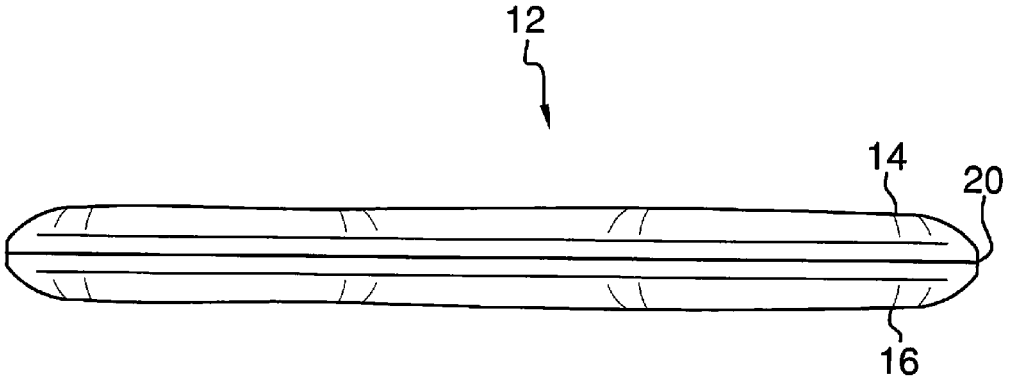
FIG. 3 is a right side view of an embodiment of the disclosure.
Figure 4:
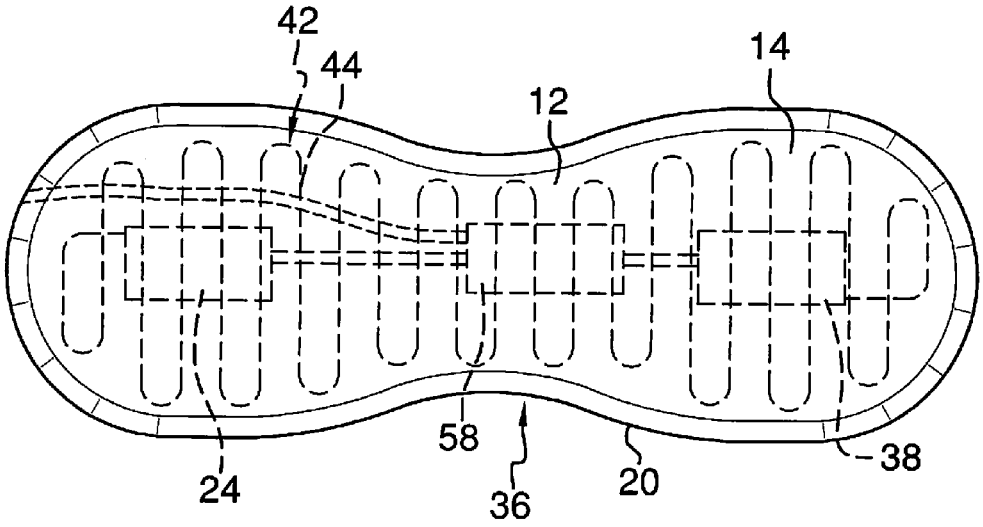
FIG. 4 is a top view of an embodiment of the disclosure.
Figure 5:
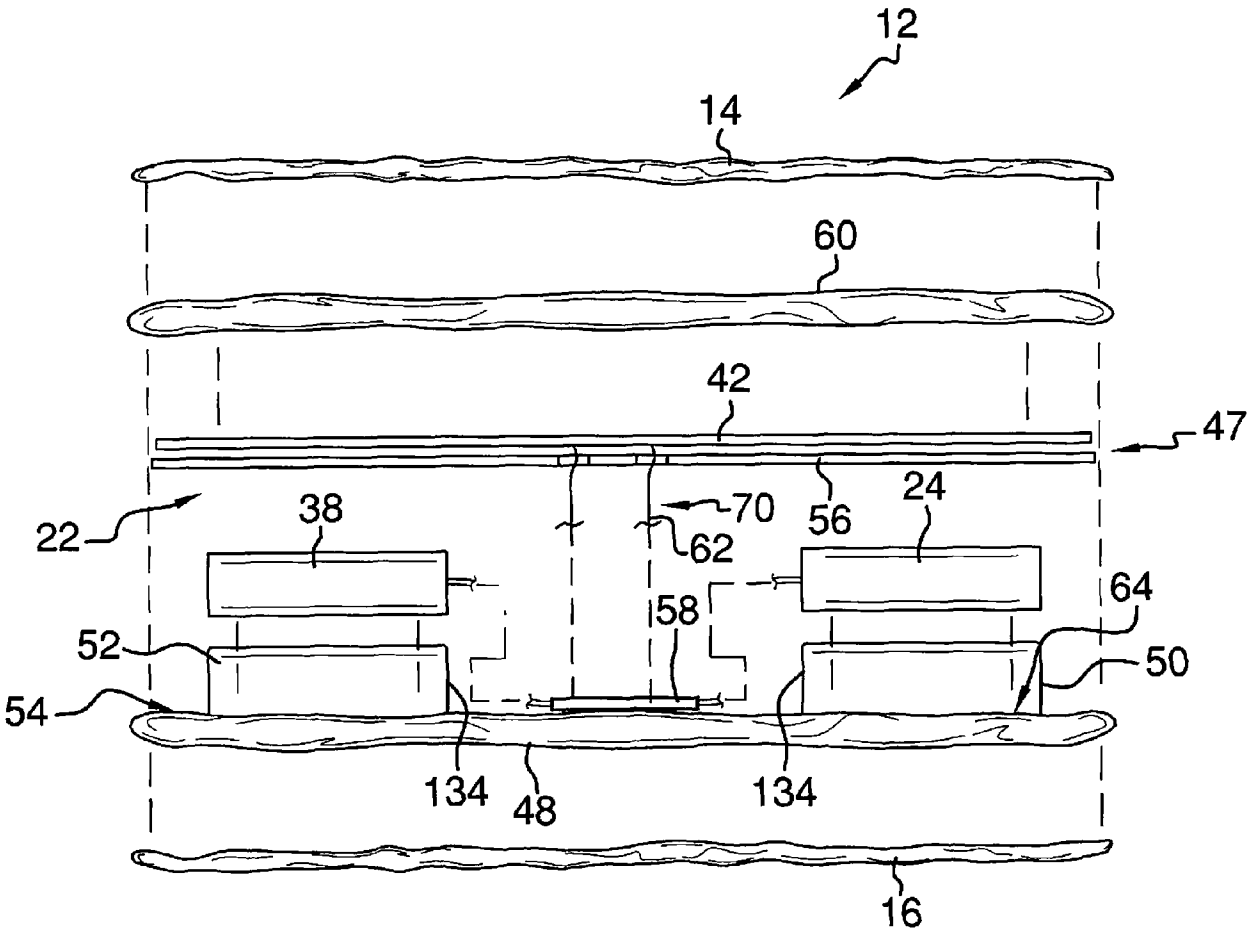
FIG. 5 is a right side exploded view of an embodiment of the disclosure.
Figure 6:
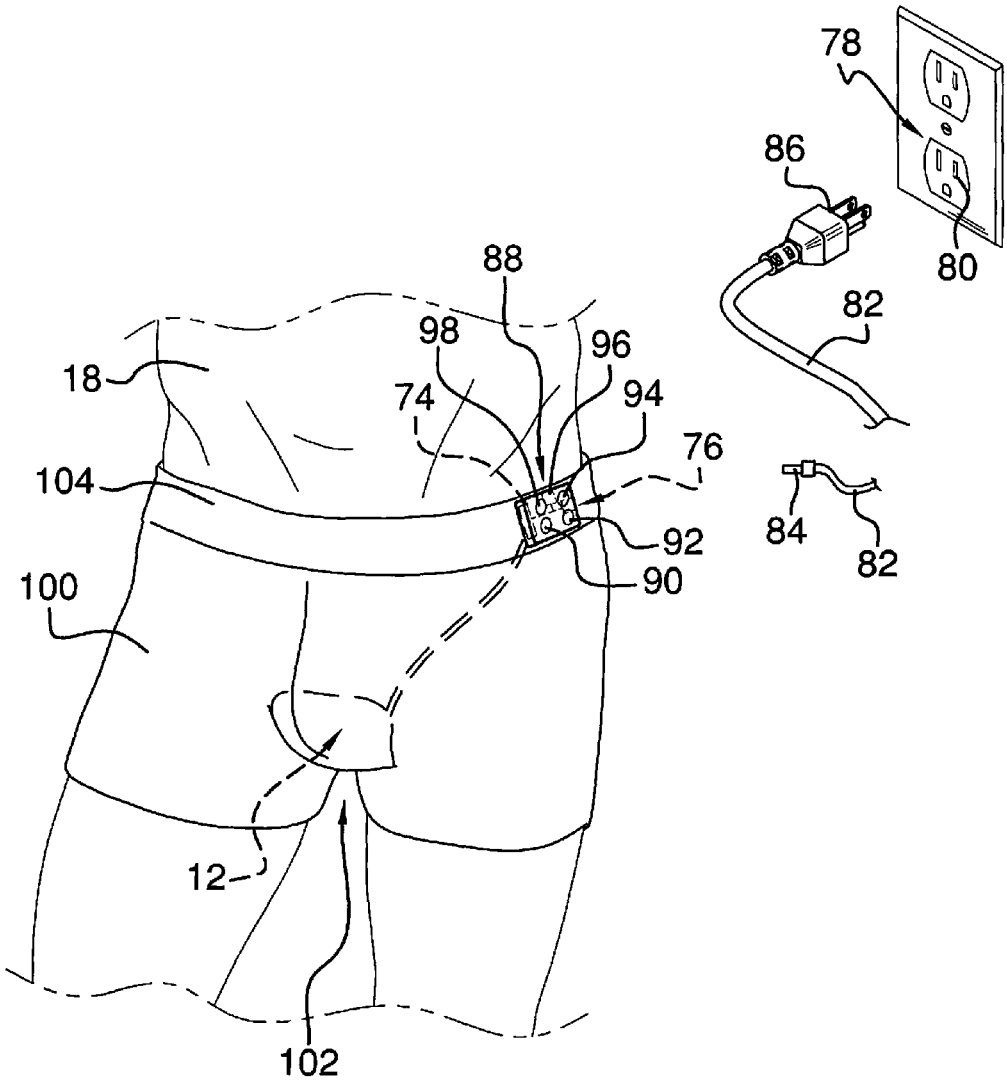
FIG. 6 is an in-useview of an embodiment of the disclosure.

With reference now to the drawings, and in particular to FIGS. 1 through 6 thereof, a new perineal massage device embodying the principles and concepts of an embodiment of the disclosure and generally designated by the reference numeral 10 will be described.

As best illustrated in FIGS. 1 through 6, the perineal massage assembly 10 generally comprises an elongated pad 12 having a top layer 14 and a bottom layer 16. The top layer 14 and bottom layer 16 may each be constructed of a plastic material. The pad 12 has a sufficient length wherein the pad 12 is configured for positioning adjacent to a perineum and anus of a person 18. The top layer 14 of the pad 12 is coupled to the bottom layer 16 of the pad 12 around a perimeter edge 20 of the pad 12 defining an interior space 22 within the pad 12. An elongated first vibratory motor 24 is coupled to the pad 12. The first vibratory motor 24 is positioned in the interior space 22 of the pad 12 and may be positioned proximate a first short end 26 of the pad 12. A longitudinal axis of the first vibratory motor 24 may be substantially parallel to longitudinal sides 28,30 of the pad 12. Each of the longitudinal sides 28, 30 may have a respective curved medial portion 32,34. The medial portions 32,34 are aligned forming a neck 36 in the pad 12 wherein the pad 12 is configured for comfortably being positioned by the person 18. An elongated second vibratory motor 38 may also be coupled to the pad 12 in the interior space 22 of the pad 12. The second vibratory motor 38 is positioned proximate a second short end 40 of the pad 12 opposite the first short end 26 of the pad 12. A longitudinal axis of the second vibratory motor 38 may be substantially parallel to the longitudinal sides 28,30 of the pad 12 and may be substantially linearly aligned with the first vibratory motor 24.

A heating element 42 is coupled to the pad 12 and is positioned in the interior space 22 of the pad 12. The heating element 42 may be a conventional elongated wire 44 formed into a planar sheet 47 providing radiant heat. The heating element 42 may be sized and shaped to provide heat to substantially a full length and width of the pad 12. A control unit 46 is operationally coupled to the first vibratory motor 24, the second vibratory motor 38 and the heating element 42 for selectively activating each of the first vibratory motor 24, the second vibratory motor 38 and the heating element 42 either separately or in combination as may be desired.

A bottom insulation panel 48 is coupled to the pad 12 in the interior space 22 and positioned between the lower layer 16 of the pad 12 and each of the first vibratory motor 24 and the second vibratory motor 38. The bottom insulation panel 48 may be constructed of a cloth or fabric material. A pair of pockets 50,52 may be formed in a top surface 54 of the bottom insulation panel 48. Each of the first vibratory motor 24 and the second vibratory motor 38 is positioned in a respective one of the pockets 50,52 in the bottom insulation panel 48. The pockets 50,52 may be sized to snugly hold each vibratory motor 24,38 to maintain relative positioning of the motors 24,38 within the interior space 22 of the pad 12 while each motor 24,38 is activated. Each of the pockets 50, 52 may have a free edge 134 that will overlap the respective motor 24,38 to further assist in maintaining the orientation and alignment of the motors 24,38 in the pockets 50,52. A heat reflective insulation panel 56 is positioned in the interior space 22 of the pad 12 between each of the first and second vibratory motors 24,38 and the heating element 42 such that the heat reflective insulation panel 56 shields each of the first and second vibratory motors 24,38 from heat radiated from the heating element 42. An upper insulation panel 60 constructed of fabric material may be coupled to the pad 12 and positioned in the interior space 22 of the pad 12. The upper insulation panel 60 is positioned between the heating element 42 and the top layer 14 of the pad 12. The upper insulation panel 60 may facilitate even distribution of radiant heat from said heating element 42.

A metal plate 58 may be coupled to the pad 12 and positioned in the interior space 22 of the pad 12. The metal plate 58 may have a length between 2.5 centimeters and 4.5 centimeters. The metal plate 58 may have a width between 0.5 centimeters and 1.0 centimeters. The metal plate 58 is positioned between the first and second vibratory motors 24,38 and is oriented substantially parallel to the top layer 14 of the pad 12. The metal plate 58 provides stiffness to the pad 12 in the neck 36 of the pad 12. Wiring 62 extends from each of the first and the second vibratory motors 24,38 to the control unit 46. The wiring 62 may include a bundled section 64 extending from the pad 12 to the control unit 46 wherein the control unit 46 is positioned extrinsically from the pad 12. The bundled section 64 of the wiring 62 may extend from the metal plate 58 to the control unit 46. The wiring 62 may also include a first motor section 66 extending from the first vibratory motor 24 to the bundled section 64 at the metal plate 58, a second motor section 68 extending from the second vibratory motor 38 to the bundled section 64 at the metal plate 58, and a heating element section 70 extending from the heating element 42 through the heat reflective insulation panel 56 to the bundled section 64 of the wiring 62 at the metal plate 58. A section 72 of the bundled section 64 intrinsic to the pad 12 may extend from the metal plate 58 forwardly through the first short end 26 of the pad 12.

A battery 74, which may be a lithium type or other conventional battery type, may be coupled to and positioned in the control unit 46. The battery 74 is electrically coupled to the heating element 42, the first vibratory motor 24, and the second vibratory motor 38 by the wiring 62. An auxiliary power port 76 may also be coupled to the control unit 46. The auxiliary power port 76 is also electrically coupled to the heating element 42, the first vibratory motor 24, and the second vibratory motor 38 by the wiring 62. Thus, the control unit 46 is configured to operate the heating element 42, the first vibratory motor 24, and the second vibratory motor 38 using a power source 78 such as a conventional power outlet 80 extrinsic to the control unit 46. A power cord 82 may be provided having a first end 84 insertable into the auxiliary power port 76 and a second end 86 couplable to the power source 78.

A plurality of control buttons 88 is coupled to the control unit 46. Each control button 88 is operationally coupled to an associated one of the heating element 42, the first vibratory motor 24, and the second vibratory motor 38 wherein each of the heating element 42, the first vibratory motor 24 and the second vibratory motor 38 are selectively controlled by manipulation of the control buttons 88. The control buttons 88 may include a first motor control 90, a second motor control 92, and a heat control 94 each being operationally coupled to the associated one of the first motor 24, second motor 38, and heating element 42. A timer 96 may be coupled to the control unit 46 and operationally coupled to each of the heating element 42, the first vibratory motor 24, and the second vibratory motor 38 for selectively controlling a duration of activation of each of the heating element 42, the first vibratory motor 24 and the second vibratory motor 38. The control buttons 88 may include a timer control 98 operationally coupled to the timer 96.

The assembly 10 may be provided for use with an existing conventional undergarment or may be incorporated into an undergarment 100 having a crotch 102 and a waistband 104 by coupling the pad 12 to the crotch 102 of the undergarment 100. The control unit 46 may be coupled to the waistband 104 of the undergarment 100 to facilitate access to the control buttons 88 on the control unit 46. The undergarment 100 may be constructed of a resiliently elastic material wherein the undergarment 100 is substantially form fitting to the person 18.

In use, the pad 12 is positioned adjacent to the perineum and anus of the person 18. The motors 24,38 and heating element 42 are selectively activated to warm and stimulate the perineum and anus to promote health or healing of the perineal area of the body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A perineal massage assembly comprising:

an elongated pad having a top layer and a bottom layer, said pad having a length wherein said pad is configured for positioning adjacent to a perineum and anus of a person, said top layer of said pad being coupled to said bottom layer of said pad around a perimeter edge of said pad defining an interior space within said pad;

a first vibratory motor being coupled to said pad, said first vibratory motor being positioned in said interior space of said pad;

a heating element being coupled to said pad, said heating element being positioned in said interior space of said pad;

a control unit being operationally coupled to said first vibratory motor and said heating element for selectively activating said first vibratory motor and said heating element;

a second vibratory motor being coupled to said pad, said second vibratory motor being positioned in said interior space of said pad, said control unit being operationally coupled to said second vibratory motor for selectively activating said second vibratory motor;

said first vibratory motor being positioned proximate a first short end of said pad and said second vibratory motor being positioned proximate a second short end of said pad opposite said first short end of said pad;

a heat reflective insulation panel being positioned in said interior space of said pad between each of said first and second vibratory motors and said heating element wherein said first and second vibratory motors are shielded from heat radiated from said heating element by said heat reflective insulation panel;

a metal plate being coupled to said pad and positioned in said interior space of said pad, said metal plate being positioned between said first and said vibratory motors, said metal plate being oriented substantially parallel to said top layer of said pad;

wiring extending from each of said first and said vibratory motors and said control unit, said wiring extending from said pad to said control unit wherein said control unit is positioned extrinsically from said pad;

a battery coupled to and positioned in said control unit, said battery being electrically coupled to said heating element, said first vibratory motor, and said second vibratory motor by said wiring; and an undergarment having a crotch and a waistband, said pad being coupled to said crotch of said undergarment, said control unit being coupled to said waistband of said undergarment.

2. The assembly of claim 1, further comprising each of said first vibratory motor and said second vibratory motor being elongated, a respective longitudinal axis of each of said first vibratory motor and said second vibratory motor being substantially parallel to longitudinal sides of said pad.

3. The assembly of claim 1, further comprising a bottom insulation panel being positioned between said bottom layer of said pad and each of said first and second vibratory motors.

4. The assembly of claim 3, further comprising a pair of pockets being formed in a top surface of said bottom insulation panel, each of said first and said vibratory motors being positioned in a respective one of said pockets in said bottom insulation panel.

5. The assembly of claim 1, further comprising an upper insulation panel being coupled to said pad and positioned in said interior space of said pad, said upper insulation panel being positioned between said heating element and said top layer of said pad.

6. The assembly of claim 1, further comprising an auxiliary power port, said auxiliary power port being coupled to said control unit, said auxiliary power port being electrically coupled to said wiring wherein said control unit is configured to operate said heating element, said first vibratory motor, and said second vibratory motor using a power source extrinsic to said control unit.

7. The assembly of claim 1, further comprising a plurality of control buttons being coupled to said control unit, each control button being operationally coupled to an associated one of said heating element, said first vibratory motor, and said second vibratory motor wherein each of said heating element, said first vibratory motor and said second vibratory motor are selectively controlled by manipulation of said control buttons.

8. The assembly of claim 1, further comprising a timer coupled to said control unit, said timer being operationally coupled to each of said heating element, said first vibratory motor, and said second vibratory motor for selectively controlling a duration of activation of each of said heating element, said first vibratory motor and said second vibratory motor.

9. A perineal massage assembly comprising:

an elongated pad having a top layer and a bottom layer, said pad having a length wherein said pad is configured for positioning adjacent to a perineum and anus of a person, said top layer of said pad being coupled to said bottom layer of said pad around a perimeter edge of said pad defining an interior space within said pad;

an elongated first vibratory motor being coupled to said pad, said first vibratory motor being positioned in said interior space of said pad, said first vibratory motor being positioned proximate a first short end of said pad, a longitudinal axis of said first vibratory motor being substantially parallel to longitudinal sides of said pad;

an elongated second vibratory motor being coupled to said pad, said second vibratory motor being positioned in said interior space of said pad, said second vibratory motor being positioned proximate a second short end of said pad opposite said first short end of said pad, a longitudinal axis of said second vibratory motor being substantially parallel to said longitudinal sides of said pad;

a heating element being coupled to said pad, said heating element being positioned in said interior space of said pad;

a control unit being operationally coupled to said first vibratory motor, said second vibratory motor and said heating element for selectively activating said first vibratory motor, said second vibratory motor and said heating element;

a bottom insulation panel being positioned between said bottom layer of said pad and each of said first and second vibratory motors;

a pair of pockets being formed in a top surface of said bottom insulation panel, each of said first and said vibratory motors being positioned in a respective one of said pockets in said bottom insulation panel;

a heat reflective insulation panel being positioned in said interior space of said pad between each of said first and second vibratory motors and said heating element wherein said first and second vibratory motors are shielded from heat radiated from said heating element by said heat reflective insulation panel;

a metal plate being coupled to said pad and positioned in said interior space of said pad, said metal plate being positioned between said first and said vibratory motors, said metal plate being oriented substantially parallel to said top layer of said pad;

an upper insulation panel being coupled to said pad and positioned in said interior space of said pad, said upper insulation panel being positioned between said heating element and said top layer of said pad;

wiring extending from each of said first and said vibratory motors and said control unit, said wiring extending from said pad to said control unit wherein said control unit is positioned extrinsically from said pad;

a battery coupled to and positioned in said control unit, said battery being electrically coupled to said heating element, said first vibratory motor, and said second vibratory motor by said wiring;

an auxiliary power port, said auxiliary power port being coupled to said control unit, said auxiliary power port being electrically coupled to said wiring wherein said control unit is configured to operate said heating element, said first vibratory motor, and said second vibratory motor using a power source extrinsic to said control unit;

a plurality of control buttons being coupled to said control unit, each control button being operationally coupled to an associated one of said heating element, said first vibratory motor, and said second vibratory motor wherein each of said heating element, said first vibratory motor and said second vibratory motor are selectively controlled by manipulation of said control buttons;

a timer coupled to said control unit, said timer being operationally coupled to each of said heating element, said first vibratory motor, and said second vibratory motor for selectively controlling a duration of activation of each of said heating element, said first vibratory motor and said second vibratory motor; and an undergarment having a crotch and a waistband, said pad being coupled to said crotch of said undergarment, said control unit being coupled to said waistband of said undergarment, said undergarment being constructed of a resiliently elastic material.

* * * * *